US006361039B1

(12) United States Patent
in 't Zandt et al.

(10) Patent No.: US 6,361,039 B1
(45) Date of Patent: Mar. 26, 2002

(54) SHEET DEPOSITION DEVICE FOR SELECTIVE DEPOSITION OF SHEETS ON SUPERIMPOSED SUPPORTS

(75) Inventors: Ronald Peter Hubertus in 't Zandt, Sevenum; Lodewijk Tarcisius Holtman, Venlo; Johan Eric Ernestus Smit, Melick; René François Albert Collard, Gennep, all of (NL)

(73) Assignee: Océ-Technologies B.V. (NL)

( * ) Notice: Subject to any disclaimer, the term of this patent is extended or adjusted under 35 U.S.C. 154(b) by 0 days.

(21) Appl. No.: 09/645,597

(22) Filed: Aug. 25, 2000

(30) Foreign Application Priority Data

Aug. 27, 1999 (NL) ..... 1012923

(51) Int. Cl.[7] ..... B65H 31/24
(52) U.S. Cl. ..... 271/159; 271/292
(58) Field of Search ..... 271/159, 164, 271/292, 293, 294; 270/58.14, 58.15, 58.19

(56) References Cited

U.S. PATENT DOCUMENTS

| | | | | |
|---|---|---|---|---|
| 4,021,710 A | * | 5/1977 | Fichte et al. | 318/39 |
| 6,142,463 A | * | 11/2000 | Leichnitz et al. | 271/159 |
| 6,146,085 A | * | 11/2000 | Namba et al. | 414/789.9 |
| 6,227,539 B1 | * | 5/2001 | Ferrara | 271/293 |
| 6,231,045 B1 | * | 5/2001 | Yamada et al. | 271/292 |

FOREIGN PATENT DOCUMENTS

| | | | | |
|---|---|---|---|---|
| EP | 0532069 A | | 3/1993 | |
| EP | 1 086 917 A1 | * | 3/2001 | B65H/31/24 |
| JP | 57-77134 | * | 5/1982 | B65H/1/30 |

* cited by examiner

*Primary Examiner*—Christopher P. Ellis
*Assistant Examiner*—Kenneth W Bower
(74) *Attorney, Agent, or Firm*—Birch, Stewart, Kolasch & Birch, LLP

(57) ABSTRACT

A sheet deposition device for the deposition of printed sheets on superimposed supports, where each support is provided with its own drive means for moving said support up and down between a deposition position, in which sheets can be deposited on that support, and a parking position, in which sheet deposition is not possible. Each support is also provided with detection means for detecting an obstacle in the space directly therebeneath, for example, sheets on a support directly therebeneath, said detection means delivering a first detection signal when the distance between the support provided with said detection means and an obstacle directly therebeneath is greater than a predetermined amount and said detection means delivering a second detection signal when said distance is equal to said predetermined amount. A control device in response to the reception of a first detection signal makes the drive means capable of activation for moving towards one another the supports between which are situated the detection means delivering the first detection signal and deactivates the drive means in response to the reception of a second detection signal.

11 Claims, 4 Drawing Sheets

SHEET DEPOSITION DEVICE FOR SELECTIVE DEPOSITION OF SHEETS ON SUPERIMPOSED SUPPORTS

BACKGROUND OF THE INVENTION

The present invention relates to a sheet deposition device for the selective deposition of printed sheets on a number of superimposed supports wherein each support is provided with its own drive means for moving said support up and down between a deposition position in which sheets can be deposited on that support and a parking position in which sheet deposition is not possible.

A sheet deposition device of this kind is known from European Patent 0 532 069. In this known sheet deposition device, when a predetermined maximum number of sheets has been deposited on one of the supports, a change-over can be made to the further deposition of sheets on one of the other supports, provided there are no sheets present on said other support, and this can be detected by a detector at the support surface of a support. During the displacement of a support, which is necessary for the purpose, with the maximum number of sheets thereon, to a lower parking position, said support will come entirely outside the deposition range of a support subsequently placed in the deposition position, in order to prevent the latter support from colliding, in its deposition position, against the sheets on the support which has been set to its lower parking position and would therefore be obstructed in its further movement.

SUMMARY OF THE INVENTION

The object of the present invention is to provide a sheet deposition device wherein a support is movable between the deposition position and the parking position provided that there is still free space for movement between the superimposed supports and without the supports, possibly with sheets therebetween, jamming against one another. To this end, according to the present invention, a support is provided with detection means for detecting an obstacle in the space directly therebeneath, for example sheets on a support directly therebeneath, which detection means delivers a first detection signal, when the distance between the support provided with said detection means and an obstacle therebeneath is greater than a predetermined amount, and delivers a second detection signal, when said distance is equal to said predetermined amount. The sheet deposition device comprises a control device which in response to reception of a first detection signal makes the drive means capable of activation for moving towards one another the supports between which are situated the detection means delivering the first detection signal and which deactivate the said drive means in response to the reception of a second detection signal.

According to one aspect of the present invention, the detection means comprises a flat plate suspended beneath a support and movable between a first position in which the plate is situated at some distance from and parallel to said support and a second position in which the plate is situated at an even shorter distance from said support. The detection means further comprises switching means between the plate and the support with actuating means which are rigidly connected to the movable plate and in the first position of the plate actuate the switching means to deliver the first detection signal and in the second position of the plate actuate the switching means to deliver the second detection signal.

The effect of the flat plate is that an obstacle beneath a support can be detected over a relatively large range, this being important particularly if the object is a stack of sheets on a support situated directly beneath the relevant support, which does not have a flat top, for example, because the stack consists of stapled sets which have a relatively considerable thickness at the staple position.

Preferably, the plate is provided with fixing means near its opposite edges, which connect the plate to the support for movement in the vertical direction and switching means are provided at each of said fixing means. The effect of this is that an obstacle can be readily detected at any place beneath a support without considerable room for movement for the plate being necessary for this purpose.

Preferably, one of the detecting means further comprises a U-shaped strap, of which the intermediate piece connecting its arms is connected for rotation about its longitudinal axis to one of the plates or supports for connection and the ends of the arms are rotatably connected to the other plate or support for connection. The effect of this is that during its movement from the first position to the second position the plate can tip in only one direction so that for the detection of an obstacle up to the four corner points of the plate it is only necessary to use two switching means near the fixing points in a central zone of the plate.

This gives a compact-constructed and flexible sheet deposition device in which supports with any sheets deposited thereon cannot jam against one another.

According to another aspect of the present invention, the control device of the sheet deposition device comprises control means which in response to the reception of a first detection signal delivered by the detection means at a support in a deposition position or a support therebeneath, make the drive means of said supports capable of activation for moving said support(s) downwards on deposition of the subsequent sheets on said support. As a result, sheets on a support in its parking position can lie within the range of deposition positions of a support thereabove, such range being increased when sheets are removed from the support in its parking position. Another effect is that deposition of sheets can be continued as long as there is anywhere free room for movement beneath the support in the deposition position.

According to yet another aspect of the present invention, the control device comprises control means which, upon displacement of a support from a parking position to its deposition position and in response to the reception of a first detection signal delivered by the detection at another support situated between the said parking position and the deposition position, makes the drive means of said other support or supports capable of activation for joint downward or upward movement, with the support to be displaced into its deposition position. The effect of this is that supports with any sheets thereon which stand in the way of a support being moved into its deposition position are automatically moved out of the way provided there is still room where the support requiring to be moved away can be moved away.

BRIEF DESCRIPTION OF THE DRAWINGS

Other features and advantages of the sheet deposition device according to the present invention will be explained hereinafter with reference to the accompanying drawings wherein.

DETAILED DESCRIPTION OF THE INVENTION

Figure 1:
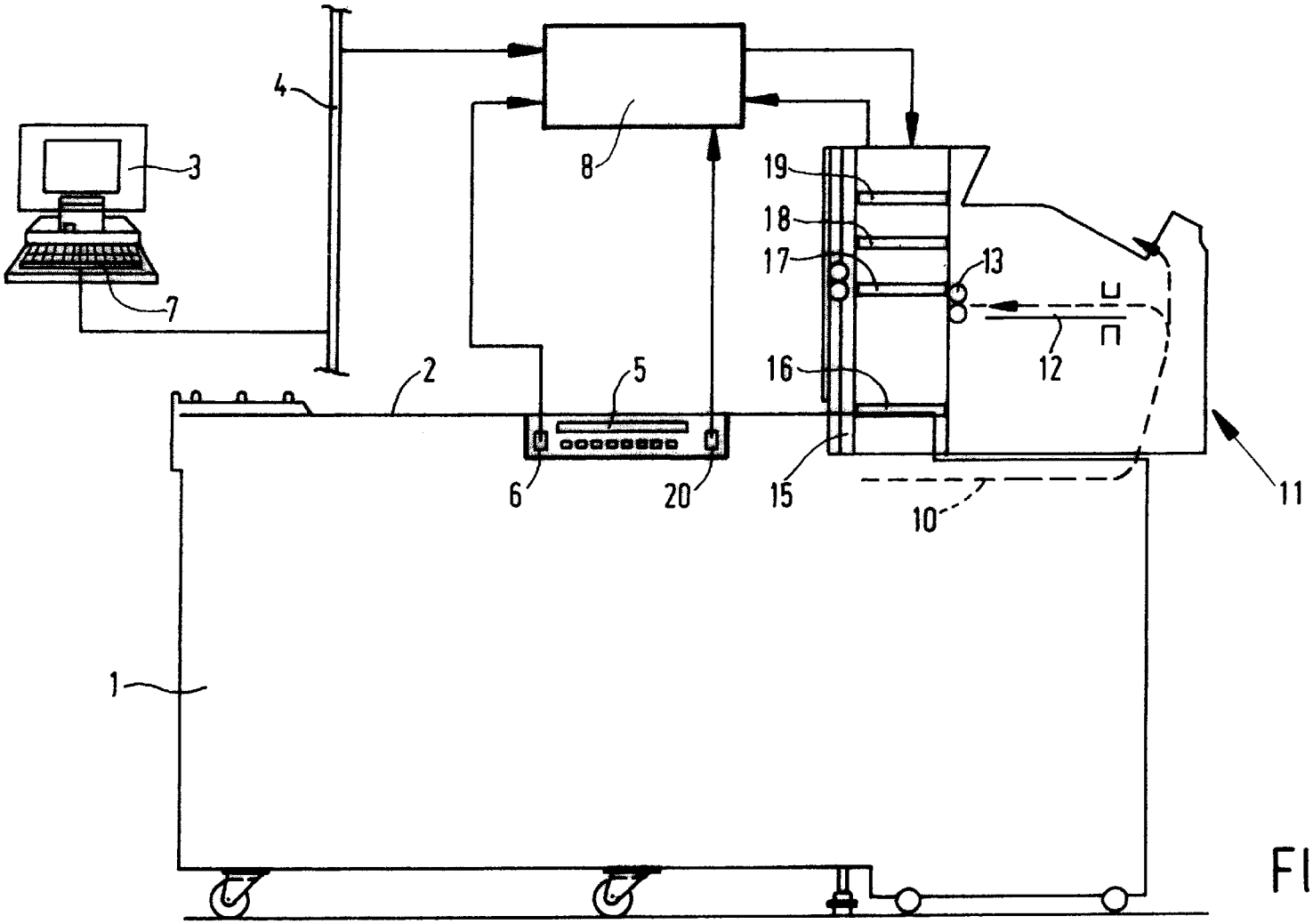
FIG. 1 illustrates one embodiment of a printing apparatus using a sheet deposition device according to the present invention.

The printing apparatus 1 shown in FIG. 1 comprises means known per se for printing an image on a receiving sheet. These images for printing may be present on original documents which are fed to a scanning station 2 situated at the top of the printing apparatus 1. Images for printing can also be fed in digital form from a workstation 3 connected via a network 4 to a control device 8 of the printing apparatus 1.

A printing cycle for copying a set of originals presented via the scanning station 2 is started by actuating a start button 6 on the operator control panel 5 of the printing apparatus 1.

A printing cycle for printing a set of images presented via workstation 3 can be started by actuating a start button 7 provided on the workstation 3, via control device 8 (hereinafter referred to as automatic printing), or by actuating a start button 6 provided on the operator control panel 5 of the printing apparatus 1 (hereinafter referred to as semi-automatic printing).

In the printing apparatus 1, the sheet transport path 10 forms the path for delivering to a sheet finishing station 11 the sheets printed in the printing apparatus.

The finishing station 11 contains a sheet collecting tray 12 (not shown in detail) in which a number of printed sheets belonging to a set can be collected and stapled, whereafter discharge roller pairs 13 feed the set of printed sheets to a sheet deposition unit 15 forming part of a sheet deposition station 11.

The sheet deposition unit 15 comprises four superimposed deposition tables 16, 17, 18 and 19, each of which can be set to a deposition position with respect to the horizontal discharge path formed by the discharge roller pair 13, to receive sheets discharged by the discharge roller pair 13. The vertical displacement of the deposition tables can be effected by means of the displacement mechanism described in European Patent Specification 0 532 069, the selected deposition table or the sheet at the top thereof always lying just beneath the discharge path formed by the discharge roller pair 13.

FIG. 1 shows the bottom deposition table 16 in a bottom deposition position in which a maximum number of sheets is situated on said deposition table 16 and the deposition tables 17, 18 and 19 situated thereabove are in parking positions situated above the discharge path formed by the discharge roller pair 13.

Since the deposition tables 17, 18 and 19 are adjustable as to height independently of deposition table 16, after sheets have been removed from deposition table 16 the top deposition table 19 can if necessary also be placed in a deposition position without the bottom deposition table 16 needing to be moved further down than the bottom deposition position shown in FIG. 1.

As a result, the finishing station 11 with the sheet deposition unit 15 adjacent the same is very suitable for being positioned at the top of a printing apparatus 1, the top of which with the scanning station 2 is situated at a normal working height for a standing operator of about 100 cm. In the printing apparatus 1 with the finishing station 11 as shown in FIG. 1, the removal height for sheets delivered on deposition tables 16, 17, 18 and 19 is between 100 cm and 160 cm for a total sheet deposition capacity of about 3000 sheets. The sheet deposition level defined by the fixed discharge rollers 13 is approximately 133 cm, and this level corresponds to the deposition level wherein the bottom deposition table 16 is in its bottom deposition position.

The combination of high deposition capacity and limited overall height is rendered possible by using the bottom deposition table 16 solely for the deposition of prints of a first type, the printing cycle of which is initiated with a setting button on the printing apparatus, so that the operator who makes this setting can also remove the deposited prints shortly thereafter, giving the deposition tables situated thereabove the opportunity to come into their deposition position and receive prints, the printing cycle of which is initiated from a workstation 3 at a distance from the printing apparatus.

According to the present invention, higher-level deposition tables can also be placed in a deposition position when prints are still situated on or beneath a lower-level deposition table providing there is still room to move the higher-level support down into its deposition position.

Figure 2:
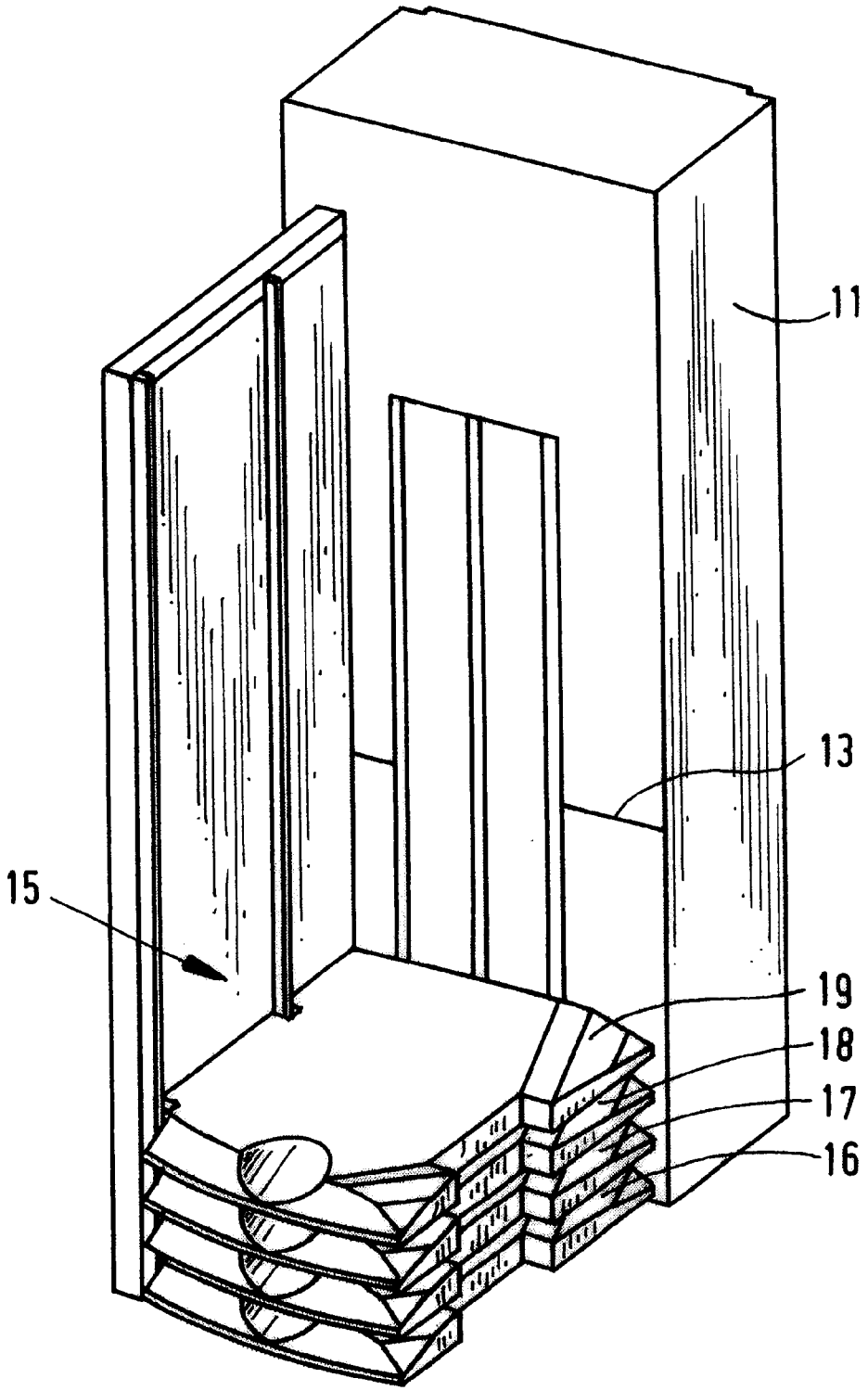
FIG. 2 shows the sheet deposition device of FIG. 1 with supports shown in their bottom positions.

Therefore, according to the present invention, each deposition table is provided with detection means which enable the higher-level deposition table to move down provided there is still free room for movement beneath said deposition table. The underside of each deposition table 17, 18 and 19 is for this purpose provided with the means indicated in FIG. 2.

Figure 3:
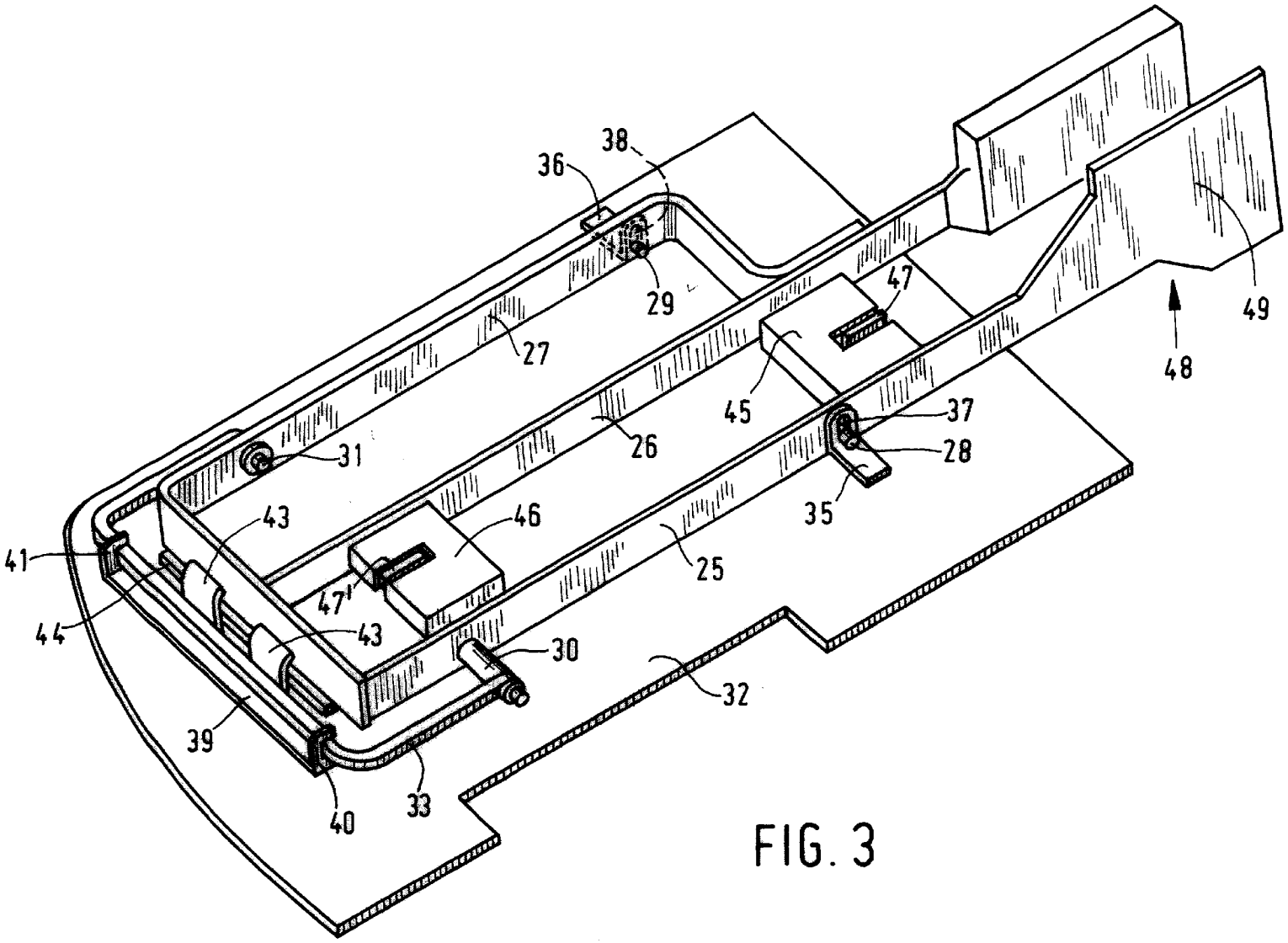
FIG. 3 is a perspective view of detection means mounted beneath each support of the sheet deposition device show in FIGS. 1 and 2.

To prevent the bottom deposition table 16 from jamming, during the downward movement, against an obstacle situated beneath the bottom deposition table, for example originals or copies lying on the top of the printing apparatus 1 next to the scanning station, the bottom deposition table 16 is also provided with the same detection means as the deposition table 17, 18 and 19. Accordingly, each deposition table 16, 17, 18 and 19 is provided with two straps 25, 26 shown in FIG. 3, to the top of which there is secured a sheet deposition plate (not shown in FIG. 3).

A U-shaped strap 27 extends from one of the adjacent straps 25 and 26 and is secured to strap 26 and is situated in the same horizontal plane as the straps 25 and 26.

Looking in a direction in which sheets are fed to the deposition plate by the transport roller pair 13, the straps 25 and 27 extend beneath the sides of the deposition plate and are rigidly connected thereto.

Pins 28, 29; 30, 31 respectively are fixed at the sides of the straps 25 and 27 extending away from one another. Looking in the sheet discharge direction, pins 28 and 29 are situated opposite one another at the upstream end of the straps 25 and 27. A flat switch plate 32 extending parallel to the deposition plate is situated beneath the straps 25, 26 and 27. Two brackets 35 and 36 are fixed on the switch plate 32.

Upright parts of the brackets 35 and 36 are provided with slots 37 and 38 extending vertically and accommodating pins 28 and 29 with clearance. A hinge arm 33 bent with a U-shaped configuration is rotatably connected at the ends of its arms to pins 30 and 31 respectively. The hinge arm 33 extends around the straps 25, 26 and 27 and is in the same plane as the straps.

A U-shaped bent strip 39 is fixed on the switch plate 32. The upright arms of the strip 39 are provided with indentations 40 and 41 in which the center piece of the hinge arm fits. The switch plate 32 is also provided with a strip which, at the top, has bent-over edges 43 which, in the position of rest of the switch plate 32, rests on a projection 44 fixed on the strap 27. In the position of rest of the switch plate 32, the top edges of slots 37 and 38 rest on pins 28 and 29 respectively and the bent-over parts 43 rest on projection 44. In this position of rest the switch plate 32 is situated a short distance, e.g. a distance of 7 mm, beneath the straps 25, 26 and 27 and extends parallel to the deposition plate fixed on these straps.

When a deposition table moves down and the switch plate 32 meets an obstacle therebeneath (e.g. a sheet stack on a deposition table therebeneath), then on the further downward movement of the deposition table the switch plate 32 is pressed in the direction of the straps 25, 26 and 27 until the switch plate encounters the straps. This movement of the switch plate 32 is made possible by the slots 37 and 38 and by the turning of the hinge arm 33. The construction of the hinge arm 33 held in indentations 40 and 41 ensures that the switch plate 32 can not rotate about a line extending parallel to the sheet discharge direction. The switch plate can only tip about a line extending transversely of the sheet discharge direction. When the switch plate 32 first comes into contact with an obstacle at the upstream side, then the switch plate 32 moves upwards only at that side in the two slots 37 and 38, even if the obstacle is situated only beneath one corner part on that side, and when the switch plate 32 first comes into contact with an obstacle on the downstream side then the switch plate 32 moves up only on that side with rotation of the hinge arm 33, even if the obstacle is situated only beneath one corner part on that side.

An opto-electrical switch 45 is disposed on the upstream side of each deposition table between the straps 25 and 26 and an opto-electrical switch 46 is disposed on the downstream side of each deposition table between the straps. Each of the switches 45 and 46 cooperates with a blade 47, 47' respectively fixed on the switch plate 32. During movement of the switch plate 32 in the direction of a downwardly moving deposition table, blade 47 and/or blade 47' will activate the associated switch or switches 45, 46, in response to which the drive of the downward moving deposition table is interrupted. The switching time is so chosen that switch plate 32 can thereafter still move further before it encounters the straps. During this last movement, which can take place when the opto-electrical switch refuses to operate at the correct time, e.g., because the switch plate is pressed rapidly upwards manually, the blade actuates a microswitch (not shown) which, for protection purposes, breaks the drive to all the deposition tables. The protective microswitch does not normally respond. The above-described suspension of the switch plate ensures that the activation of the switch plate can take place at each of the corner points, and yet only two switching elements are necessary instead of four. The switch plate 32 should be sufficiently torsion-resistant and is, therefore, constructed for example from 2 mm thick aluminum.

The use of the switch arm 33, situated around the straps between the deposition plate and the switch plate, ensures a flat construction which, for example, has a total overall height of only 20 mm with the required stroke length of 7 mm for the switch plate, of which, for example, 4 mm is for the opto-electrical switches and 3 mm for the protective microswitch.

At the drive side 48, where they are connected to a motor which can adjust the associated deposition table as to height, the straps 25 and 26 have an elevation 49 by means of which they can come into contact with the strap of a deposition table thereabove. This elevation is of a size such that two tables between which there are no sheets cannot come so close together that the protective microswitch can respond. Only when there are sheets or some other obstacle between the deposition tables will the microswitch respond and the switching off of the motors which move the deposition tables can be rendered inoperative by the removal of the sheets which cause the microswitch to respond.

Figure 4:
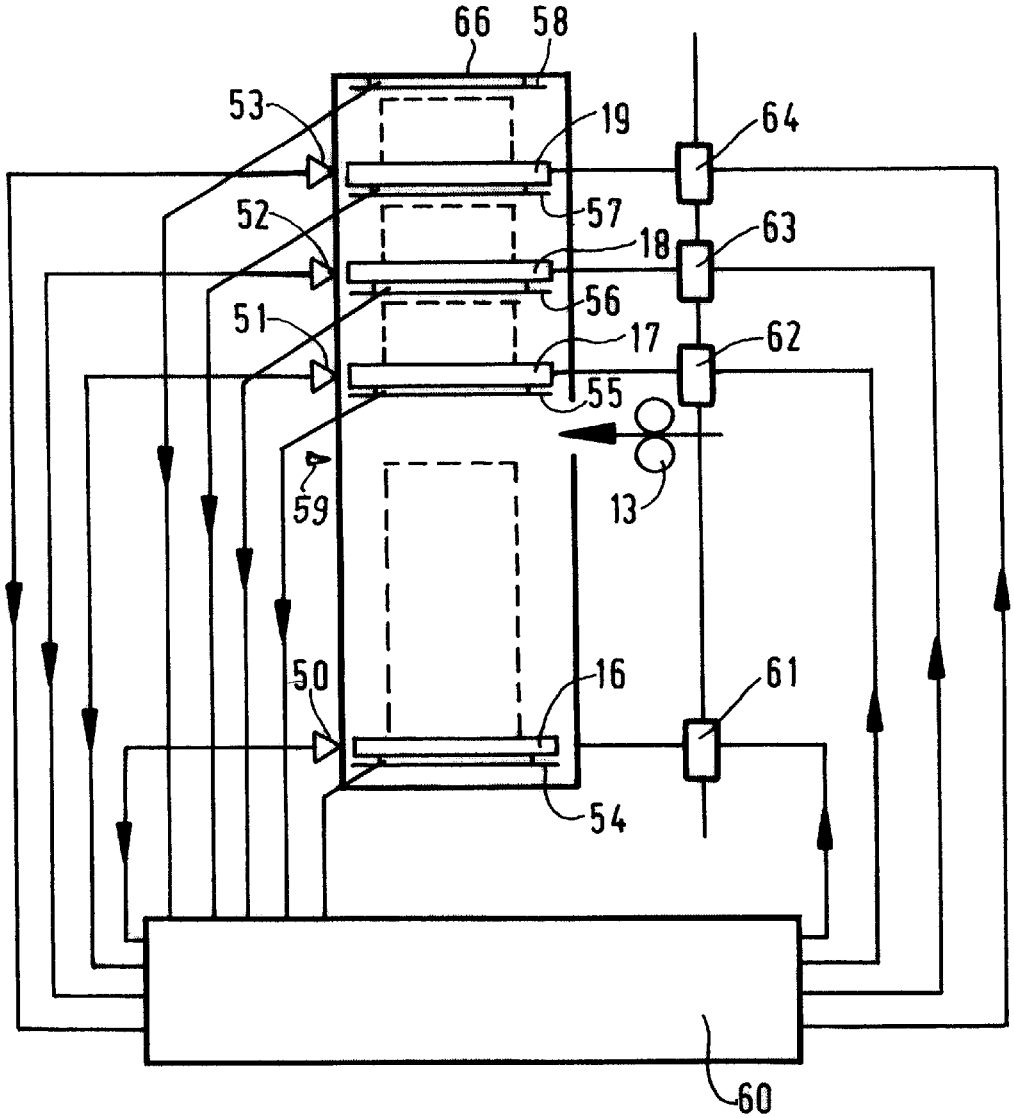
FIG. 4 is a diagram showing a sheet deposition device with the supports in their starting position and an associated control system.

In FIG. 4, the four deposition tables 16, 17, 18 and 19 are shown in their starting positions. The bottom table 16 is in the lowest possible position which is at a distance beneath the transport roller pair 13 such that it can support a predetermined maximum number of sheets, e.g. 2250 sheets. A fixed sensor 50, level with this position, detects when the support 16 is in this starting position.

The other deposition tables 17, 18 and 19 are in their starting position above the transport roller pair 13. The support 17 is above the roller pair 13, and supports 18 and 19 are disposed just above support 17 at distances such that each of these supports can support a predetermined maximum number of sheets, e.g. 500 sheets each. Fixed sensors 51, 52, 53 are disposed at the respective starting position level to detect when supports 17, 18 and 19 are in their starting positions.

The above indicated starting positions correspond to positions in which the sheet deposition device accommodates a maximum number of sheets.

Reference numeral 60 denotes a control device which sets the tables to their starting position for putting the sheet deposition device into operation.

First of all, by means of motor 61, table 16 is moved down to its very lowest position at sensor 50. Table 19 is then raised by means of motor 64 to its very highest position at sensor 53. Table 18 is then moved up by means of motor 63 until either the position at sensor 52 is reached, in the event that the table was previously in a lower position, or sensor 57 beneath table 19 is activated in the event that table 18 was previously in a higher position than the starting position. In the latter case, table 18 then moves down until it reaches the position at sensor 52. Table 17 is then raised by means of motor 62 until either the position at sensor 51 is reached, in the event that the table was previously in a lower position, or sensor 56 beneath table 18 is activated, in the event that table 17 was previously in a higher position than the starting position. In the latter case, table 17 then moves down until reaching the position at sensor 51.

When the control device 60 determines that detectors 56, 57 or 58 detect an obstacle, during the upward movement of tables 17, 18 or 19 respectively, before the relevant table has reached its starting position, then the control device 60 delivers a signal for removal of said obstacle from the associated table, for example if more than 500 sheets have been deposited thereon. Detector 58 is provided if the sheet deposition device has a cover plate 66 which prevents a free upward movement of the top table with (too) many sheets disposed thereon.

Before the start of a print cycle the table selected for deposition is brought into the deposition position.

Starting from the starting position shown in FIG. 4, this implies the following:

If deposition on the bottom table 16 is selected, motor 61 moves table 16 upwards until the top of said table is level with detector 59 disposed at a fixed short distance beneath the sheet transport rollers 13. If there are sheets on table 16 the upward movement stops when the top sheet on the table 16 reaches detector 59.

If deposition on table 17 is selected, this table moves down from the starting position until the top of table 17 or the top sheet thereon comes in the range of detector 59. When the downward movement stops before detector 59 can respond, that means that the deposition table 16 with any sheets thereon forms an obstacle and the control device 60 delivers a signal to motor 61 to lower table 16 as well. If the latter is not possible because table 16 has reached sensor 50, the control device 60 delivers a signal to the operator to remove sheets from table 16, for making space for further lowering of table 51 to its deposition position.

If a (further) downward movement of table 17 is no longer possible, while table 16 has not yet reached its extreme bottom position, then the control device 60 delivers a signal to the operator to remove sheets or some other obstacle beneath table 16.

If deposition on table 18 is selected, this table moves down until the top of the table or, if sheets are present thereon, the top of the stack of sheets thereon, comes in the range of detector 59.

During this movement, table 18 may first encounter table 17 and activate detector 56 in so doing. As a result, motor 62 is activated and moves table 17, together with table 18, downwards. Table 17 can then also meet table 16 or a sheet stack 16 thereon, so that motor 61 is also activated in the manner explained hereinbefore in connection with the selection of deposition on table 17. When table 16 has reached its starting position and if table 17 is then already past detector 59 before table 18 reaches its deposition position, the control device 60 delivers a signal to the operator to remove sheets from table 17.

If deposition on table 19 is selected, this table moves down until the top of the table or, if sheets are present thereon, the top of a stack of sheets thereon, comes in the range of detector 59.

This movement can be interrupted when detector 57 responds. Table 18 then also moves down. Detector 56 can then also respond so that table 17 also moves down. The same can then also occur at table 16. If under these conditions table 16 cannot reach its extreme bottom position, control device 60 delivers a signal for removal of sheets beneath table 16. If table 17 cannot then fall beneath detector 59, a signal is delivered for removal of sheets from table 17. Finally, if table 18 also cannot fall beneath detector 59, a signal is delivered for the removal of sheets from table 18.

Before any further deposition on one of the tables 17, 18 and 19, the control device 60 should, in the first instance, know where the associated table is situated, i.e. whether said table is situated beneath or above the deposition position. The reason for this is to enable the required direction of movement of the associated motor 62, 63 or 64 to be set. The instantaneous position of these supports can be determined by measuring the direction of displacement and the distance of each support from its starting position and storing it as memory.

On a change of deposition from a higher-level table (e.g. table 18) to a lower-level table (e.g. table 17), the latter table should move upwards but in so doing meets the detector beneath the higher-level table, e.g. detector 56. When the latter responds motor 63 also moves table 18 upwards and possibly motor 64 then also moves table 19. If the top table in the latter case reaches its extreme top position at sensor 53 before table 17 has reached its deposition position, this means that there are too many sheets on table 17 and/or table 18. In the event of too many sheets on table 18, table 18 has not yet reached its starting position at sensor 52 and a signal is delivered to remove sheets from table 18. If in that case the table 18 has passed sensor 52, that is a signal that sheets must be removed from table 17.

During the deposition of sheets on a table, said table moves down stepwise to keep the top of the sheets deposited thereon in range of the detector 59. In these conditions a detector mounted beneath the associated table can respond so that the table therebeneath is also moved down stepwise. Deposition stops when there are too many sheets on the associated table. In the case of deposition on table 16, this occurs when said table comes into its extreme bottom starting position at sensor 50. Deposition on table 17 stops when table 16 has moved down to its bottom-most starting position or when table 16 is already in that position in response to the detector 55. The stopping of deposition also applies in the case of deposition on table 18 or 19.

In some situations it may be convenient to be able to start deposition on a table which is still empty, e.g. in order to prevent copies for deposition from being added to sheets still on that table.

One solution to this problem comprises detectors on each table reacting to sheets thereon.

In the deposition of printed sheets of print jobs, various types of print jobs are possible in which the deposition of the printed sheets is distributed separately over different deposition tables.

A distinction can be made between the following in the case of separate deposition:

1. Next job printing

Successive print jobs are, as far as possible, deposited on consecutive deposition tables in their natural sequence. A user at the printer thus clearly sees when the previous job has been completed and the next job starts. Removal of the previous job is also easier.

2. Walk-up priority-printing

Print jobs initiated at the printer, i.e. not from a workstation at a distance from the printer, are deposited on a separate deposition table, e.g. on the bottom deposition table, so that the user present at the machine can see where his print job is situated.

3. Interrupt printing

In these "interim" print jobs, the current print job is interrupted for an interim job. This interim job is deposited on a different deposition table than the interrupted job, preferably the next deposition table, in order to show clearly when the printing of the interim job starts and is finished and in order to facilitate removal of the interim prints. Another advantage is that the interrupted job is delivered with out separation.

4. Continuous printing

The printer runs continuously in printing and deposits sheets provided there is still deposition space, i.e. for as long as deposition tables are emptied in good time. Deposition can start at the bottom deposition table and then continue on the deposition tables thereabove (bottom-up algorithm). Deposited prints are removed during printing and thus printing can carry on continuously.

5. Capacity printing

In order to ensure that the deposition capacity is utilised to the maximum in the case of print jobs where the user is not present at the printer, deposition is first on the top deposition table and then continues with the deposition table therebeneath (top-down algorithm).

6. Sorter printing

Print jobs are delivered sorted in respect of an adjustable feature, e.g. orders from users of group A on the bottom deposition table, of group B on the table thereabove, and so on (user groups), or orders with stapled sets on one deposition table and orders with non-stapled sets on another deliver table (stack quality printing).

It will be apparent that on a change of deposition from one deposition table to another, activation of the detection means suspended beneath the deposition tables plays an important role. They determine whether such change-over is possible and enable the sheet deposition device to allow such a change-over even when printed sheets are removed from deposition tables which are not in use. Without the detection means according to the present invention, the sheet deposition device would assume that the number of sheets deposited on a deposition table will always remain thereon until all the sheets have been removed from said deposition table, and this is detectable in known manner by an empty-detector on a deposition table.

The invention being thus described, it will be obvious that the same may be varied in many ways such variations are not to be regarded as a departure from the spirit and scope of the invention, and all such modifications as would be obvious to one skilled in the art are intended to be included within the scope of the following claims.

What is claimed is:

1. A sheet deposition device for the selective depositing of printed sheets onto a plurality of superimposed supports, wherein each support is provided with its own drive means for moving said support up and down between a deposition position where sheets can be delivered to that support and a parking position in which sheet deposition is not possible, wherein each support is provided with detection means for detecting an obstacle disposed in the space therebelow, said detection means delivering a first detection signal when the distance between the support provided with said detection means and an obstacle disposed directly therebelow is greater than a predetermined amount and delivering a second detection signal when said distance is equal to said predetermined amount, wherein the sheet deposition device includes a control device which, in response to the reception of a first detection signal makes the drive means capable of activation for moving the supports towards one another between which are situated the detection means delivering the first detection signal and which deactivate the drive means in response to the reception of a second detection signal.

2. The sheet deposition device according to claim 1, wherein the detection means comprises a flat plate suspended beneath a support and movable between a first position in which the plate is situated at some distance from and parallel to said support and a second position in which the plate is situated at an even shorter distance from said support and wherein the detection means further comprise switching means disposed between the plate and the support with actuating means which are rigidly connected to the movable plate, and in the first position of the plate actuates the switching means to deliver the first detection signal and in the second position of the plate actuates the switching means for delivery of the second detection signal.

3. The sheet deposition device according to claim 2, wherein the plate is provided with fixing means provided near opposite edges for connecting the plate to the support for movement in the vertical direction, wherein the switching means are provided at each of said fixing means.

4. The sheet deposition device according to claim 3, wherein one of said fixing means comprises a U-shaped strap, wherein the intermediate piece connecting its arms is connected for rotation about its longitudinal axis to one of the plates or supports and the ends of the arms are rotatably connected to the other plate or support for connection.

5. The sheet deposition device according to claim 2, wherein the dimensions of the flat plate correspond to the dimensions of the largest sheet for deposition.

6. The sheet deposition device according to claim 1, wherein the control device of the sheet deposition device comprises first control means which in response to the reception of a first detection signal delivered by the detection means at a support in a deposition position make the drive means capable of activation for moving said support downwards on the deposition of subsequent sheets on said support.

7. The sheet deposition device according claim 1, wherein the control device comprises second control means which, in response to the reception of a first detection signal delivered by the detection means at a support in a parking position and at a lower level than a support in a deposition position, make the drive means capable of activation of said support in the parking position, the support in the deposition position and the supports therebetween for moving said supports downwards on the deposition of subsequent sheets on the support in the deposition position.

8. The sheet deposition device according to claim 7, wherein the control device comprises third control means which, on the downward movement of a support from a parking position into its deposition position, and in response to the reception of a first detection signal delivered by the detection means at a support at a lower level than the support for displacement to its deposition position, make the drive means of said lower-level supports capable of activation for joint downward movement of the supports for displacement into its deposition position.

9. The sheet deposition device according to claim 8, wherein the control device comprises fourth control means which, on the upward displacement of a support from a parking position into its deposition position, and in response to the reception of a first detection signal delivered by the detection means at a support situated above a support at a higher level than the support for displacement into its deposition position, make the drive means of the intermediate supports capable of activation for joint upward movement of the intermediate supports.

10. The sheet deposition device according to claim 9, wherein the control device comprises a fifth control means which, in response to the reception of a first detection signal delivered by the fixed detection means make the drive means of the top support capable of activation for raising the top support and which, in response to the reception of a second detection signal delivered by the fixed detection means, deactivates the drive means of the top support to stop the movement of the top support.

11. The sheet deposition device according to claim 1, wherein further detection means are also fixed above the top support for the detection of sheets on said top support for delivering a first detection signal when the distance between the fixed detection means and the top sheet on the top support is greater than a predetermined amount and for delivering a second detection signal when said distance is equal to the predetermined amount.

* * * * *